US005318117A

United States Patent [19]

Echols, III et al.

[11] Patent Number: 5,318,117

[45] Date of Patent: Jun. 7, 1994

[54] NON-ROTATABLE, STRAIGHT PULL SHEARABLE PACKER PLUG

[75] Inventors: Ralph H. Echols, III; Colby M. Ross, both of Carrollton, Tex.

[73] Assignee: Halliburton Company, Houston, Tex.

[21] Appl. No.: 994,696

[22] Filed: Dec. 22, 1992

[51] Int. Cl.[5] ..... E21B 33/12

[52] U.S. Cl. ..... 166/114; 166/128; 166/150

[58] Field of Search ..... 166/114, 116, 126, 128, 166/143, 145, 149, 150

[56] References Cited

U.S. PATENT DOCUMENTS

| | | | |
|---|---|---|---|
| 2,092,338 | 9/1937 | Spencer | 166/1 |
| 2,604,169 | 7/1952 | Miller | 166/2 |
| 2,606,616 | 8/1952 | Otis | 166/1 |
| 2,726,723 | 12/1955 | Wilhoit et al. | 166/224 |
| 2,856,003 | 10/1958 | Fredd | 166/126 X |
| 3,454,089 | 7/1969 | Brown | 166/128 X |
| 3,559,732 | 2/1971 | Tucker | 166/114 |
| 4,164,977 | 8/1979 | Arendt et al. | 166/128 X |
| 4,638,860 | 1/1987 | Magee, Jr. et al. | 166/114 |
| 4,871,018 | 10/1989 | Caskey et al. | 166/142 |
| 4,928,761 | 5/1990 | Gazda et al. | 166/123 |

*Primary Examiner*—William P. Neuder

*Attorney, Agent, or Firm*—Tracy W. Druce; Dennis T. Griggs

[57] ABSTRACT

A two-way retrievable packer plug is installed in the production bore of a flow conductor by straight insertion, and is retrieved by a one trip straight pull operation. The plug assembly includes a core mandrel which is enclosed within a tubular latch mandrel on which an annular seal assembly is mounted for sealing engagement against the production bore of a flow conductor. A latch key is yieldably biased by a coil spring for interlocking engagement with a latch retainer lug carried on a landing receptacle attached to the flow conductor. The latch key is moveable from a radially extended position in which it is engageable against the latch retainer lug so that the latch key is blocked against axial displacement relative to the landing receptacle as the plug mandrel is inserted into or withdrawn out of the flow conductor. The latch key is moveable to a radially retracted position in which it is released from blocking engagement with the latch retainer lug to permit passage of the latch key relative to the lug as the core mandrel is fully inserted within or fully retracted from the flow conductor. The latch key is supported in the radially extended position by raised shoulder portions of the core mandrel. The core mandrel is intersected by an equalizing passage which is open during run-in and insertion. The equalizing passage is sealed automatically by a slideable isolation sleeve as the running tool is separated from the plug, and is opened automatically during retrieval of the plug.

44 Claims, 5 Drawing Sheets

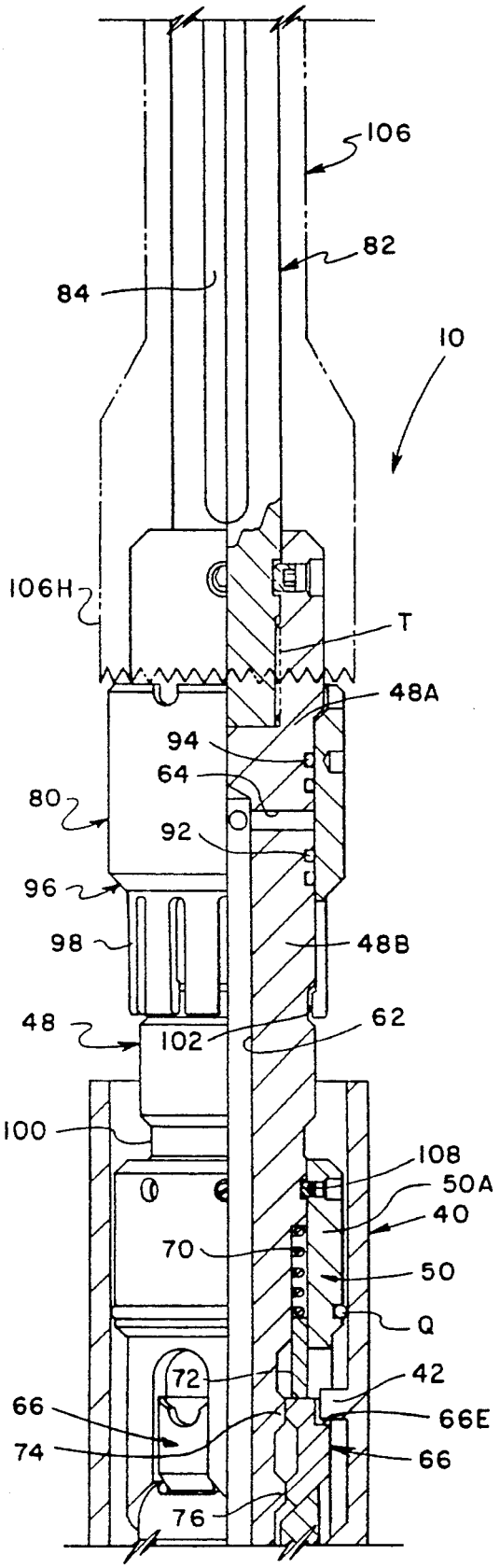
FIG. 5 LATCHED
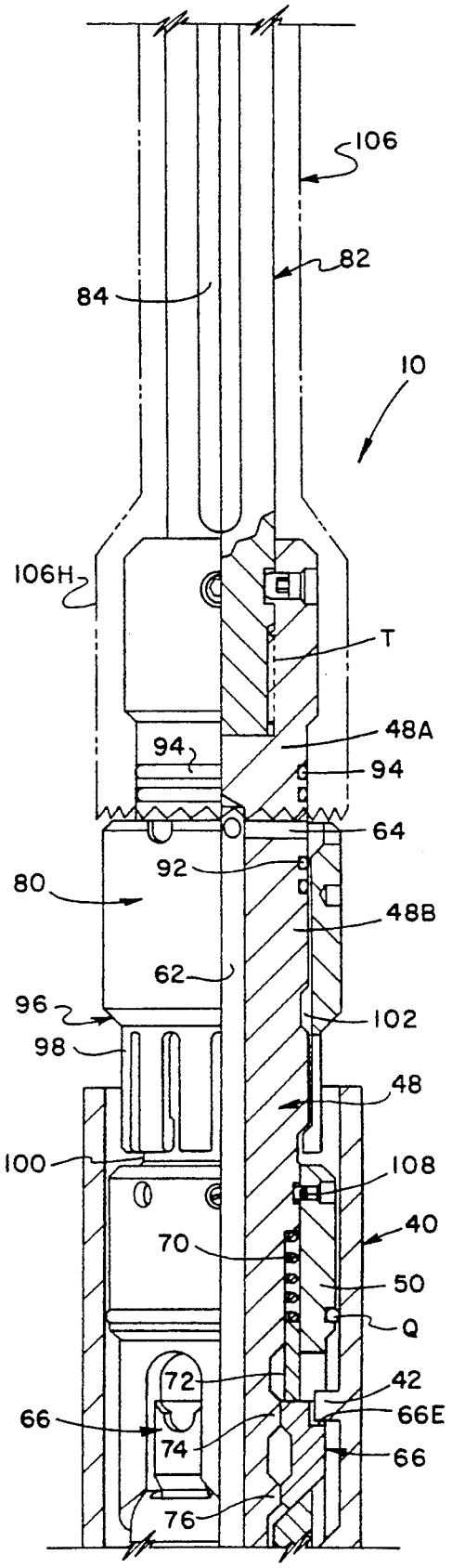
FIG. 6 EQUALIZE

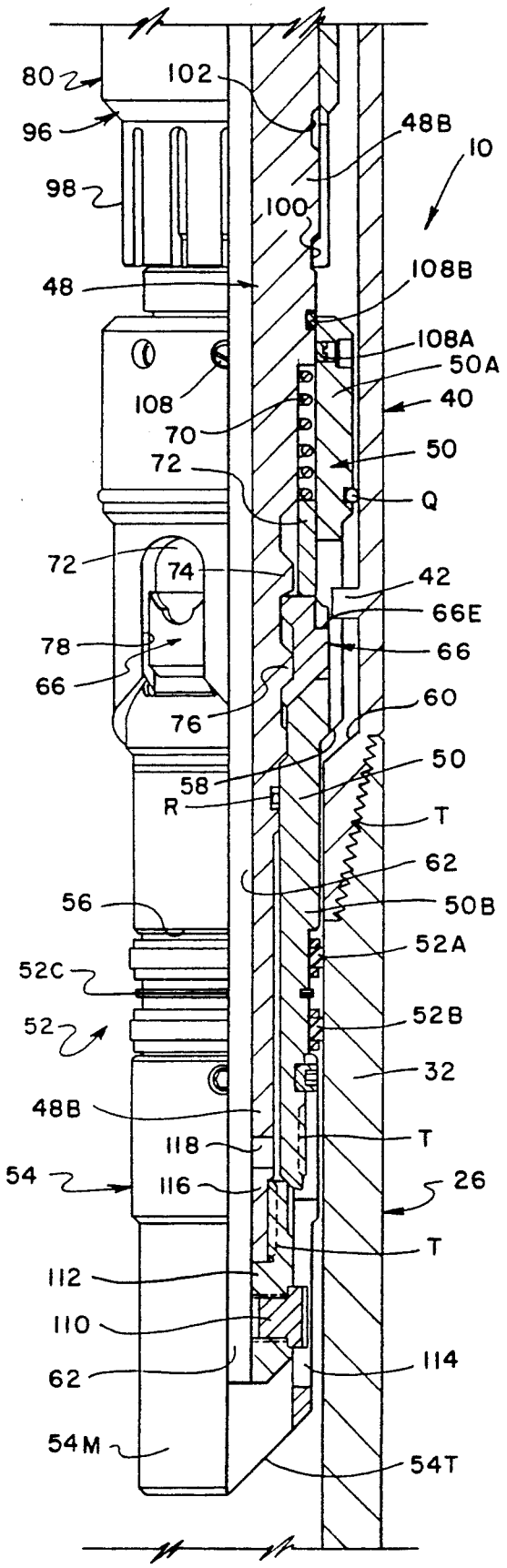
FIG. 7 RELEASED

NON-ROTATABLE, STRAIGHT PULL SHEARABLE PACKER PLUG

FIELD OF THE INVENTION

This invention relates generally to well flow conductors, and in particular to retrievable packer plugs for sealing the mandrel of a packer set in a wellbore above a formation interval.

BACKGROUND OF THE INVENTION

In the completion of oil and gas wells, it is customary to install a production packer between the production tubing and the well casing for the purpose of sealing off the high pressures of the producing formation to prevent those high fluid pressures from acting against the casing connections at the well head, and to prevent the application of such high fluid pressures to the long string of casing in place in the well bore, thereby reducing the likelihood of leaks occurring through such casing. It may become necessary from time to time to plug the production packer and temporarily suspend production to permit a service operation to be carried out, such as stimulation, or to permit venting of the casing pressure to the atmosphere so that the well head or a portion of the well tubing may be removed, or so that pressure applied above the plug may be used to test the casing, set the packer, or test the packer. Occasionally, it may be desirable to shut-in the well because of depletion or inadequate production from the formation, or because too much water is being produced from the formation.

It may be desirable to seal the well below the production packer, for example, when production is to be initiated from a higher formation interval. It is common practice to isolate the higher formation interval being completed with respect to the lower formation interval while completion is being carried out. Generally, this isolation is obtained by setting a production packer between the two intervals and temporarily plugging the packer mandrel bore with a packer plug. The packer plug is run into the well on a running tool and inserted into an upwardly facing landing receptacle or receiving head, thereby blocking flow communication through the packer mandrel. After the plug is latched into sealing engagement with the packer, the running tool is released and retrieved to the surface, leaving the plug so that it will seal the packer bore from pressure differentials, either above or below. Then the casing above the sealed packer is perforated by perforating guns, so that formation fluid can be produced from the upper formation interval.

Once the service operation is finished at the upper level, the packer plug is retrieved and the lower end of a string of production tubing is then coupled into the landing receptacle to reestablish flow communication from the lower formation interval to the surface. In a completion involving two production zones a dual bore packer is set in the well bore above the upper production interval, and formation fluid is produced from the two formation intervals through dual production tubing strings. If the lower formation interval is unproductive, the sealing plug is retained in the lower packer, and only the upper formation interval is produced.

DESCRIPTION OF THE PRIOR ART

Conventional packer plugs include a core mandrel which carries a stack of annular seal elements for sealing engagement against the packer mandrel bore, latch apparatus for releaseably locking the core mandrel to a landing receptacle or receiving head, and a bypass valve which is open during run-in to equalize pressures below and above the packer, and which can be closed when the plug is in the latched position for sealing the bypass vent passage. Some conventional plug assemblies may not be suitable for use where sediment may occur and bailing might be required before pressures across the plug can be equalized. Two trips are required to install such plugs and two trips are required to retrieve them. Some packer plugs require rotation for set and/or release. Such packer plugs cannot be used reliably in deviated wells because of limitations on torque transmission. Also, plugs which require rotation cannot be used reliably in high sediment wells because the rotary coupling devices may become obstructed by sand, cement residue, filter cake, shaped charge gun debris and the like.

Conventional sealing plugs are adapted for latching engagement with various kinds of tubular landing receptacles, sometimes referred to as landing top subs or receiving heads. Two common kinds of landing receptacles are the lug-style receiving head and the rachet-style receiving head.

OBJECTS OF THE INVENTION

The principal object of the present invention is to provide a retrievable packer plug which can be set and released by straight insertion and straight pull, respectively, without requiring rotation of the plug.

A related object of the present invention is to provide a packer plug of the character described, which requires no modification of existing conventional landing receptacles.

Another object of the present invention is to provide an improved packer plug which is capable of holding against high pressure from below, and which is also designed to hold over pressure from above, and which can equalize the pressure above and below the packer plug without requiring rotation of the plug relative to the packer.

A related object of the present invention is to provide an improved packer plug of the character described, which provides pressure equalization as it is being run into the well on a setting tool, and which automatically seals the packer bore upon release of the setting tool from the plug.

Still another object of the present invention is to provide an improved packer plug of the character described, in which only one trip is required to install the plug, and only one trip is required to release the plug.

Yet another object of the present invention is to provide an improved two-way packer plug which can be reliably set and released where sediment may occur and bailing is not required prior to engagement and retrieval.

SUMMARY OF THE INVENTION

The foregoing objects are achieved according to the present invention by a retrievable packer plug which is installed by a one trip straight insertion operation, and which is released by a one trip straight pull operation. The plug assembly has a core mandrel and a latch mandrel on which an annular seal assembly is mounted for sealing engagement against the production bore of the packer. A latch key carried within the latch mandrel is adapted for interlocking engagement with a latch retainer lug carried on a landing receptacle which is attached to the packer mandrel.

The latch key is movable from a radially extended position in which it is engageable against the latch retainer lug so that the latch key is blocked against axial displacement relative to the landing receptacle as the plug mandrel is inserted into or withdrawn out of the production bore of the packer. The latch key is moveable to a radially retracted position in which it is released from blocking engagement with the latch retainer lug to permit passage of the key relative to the lug as the core mandrel is fully inserted within or fully retracted from the packer bore.

The latch key is yieldably biased by a coil spring for movement from the radially retracted, lug clearance position to the radially extended, lug engaging position. The latch key is supported in the radially extended position by raised shoulder portions of the core mandrel. The raised shoulder portions have ramp surfaces which guide the latch key as it is moved between the radially extended and retracted positions.

According to another aspect of the invention, the plug core mandrel is partially intersected by a longitudinal vent bore and by a radial equalizing port for pressure equalization. The equalizing port is open during run-in and insertion, and is sealed automatically by a slideable isolation sleeve as the running tool is separated from the plug. The running tool and slideable sleeve are initially pinned to the plug mandrel, and the isolation sleeve is automatically moved to the sealing position upon separation of the running tool from the plug mandrel and retrieval of the running tool.

The plug assembly is then equalized during the retrieving procedure. As the work string is lowered onto the plug, the slidable sleeve is shifted back to its original uncovered position. This reopens the equalizing ports and permits the pressure differential to equalize. The plug is then ready to be released from the packer.

The plug assembly is released from latching engagement and separated from the packer mandrel by a straight upward pull which shears connecting pins and releases the latch housing from the plug core mandrel. Engagement of the latch key against the landing receptacle lug prevents longitudinal displacement of the latch key relative to the landing receptacle as the plug core mandrel is initially retrieved. Further axial displacement of the plug mandrel shifts the support shoulders from beneath the latch key and allows it to slide into the radially retracted, disengaged position. This permits the latch key to clear the landing receptacle lug so that the entire plug assembly may then be retrieved to the surface.

Other features and advantages of the present invention will be appreciated by those skilled in the art upon reading the detailed description which follows with reference to the attached drawings.

BRIEF DESCRIPTION OF THE DRAWINGS

FIG. 5 is a view similar to FIG. 4 which illustrates engagement of a retrieving tool with the fishing neck of the plug assembly and showing the plug components in the latched position;

FIG. 6 is a view similar to FIG. 5 which illustrates the relative positions of the plug components in the equalize position;

FIG. 7 is a view similar to FIG. 5 which illustrates separation of the plug mandrel and release of the latch key out of engagement with the landing receptacle lug;

DETAILED DESCRIPTION OF THE PREFERRED EMBODIMENTS

Figure 1:
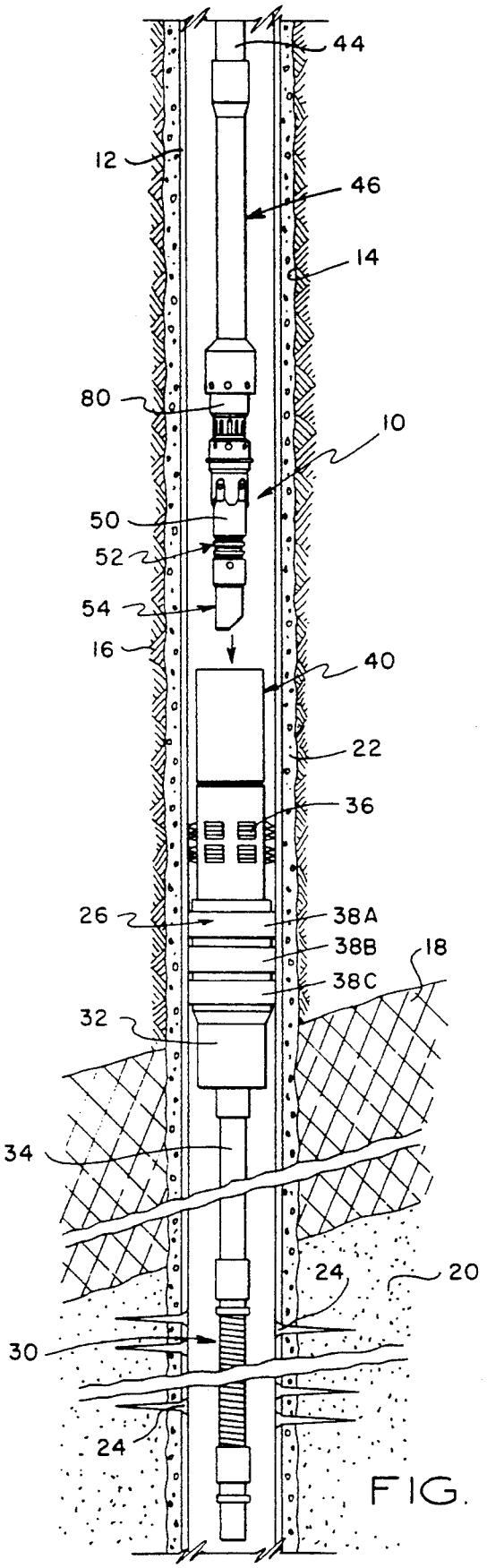
FIG. 1 is a simplified schematic diagram showing a vertical section through a producing formation which is intersected by a well casing which has been completed with a production packer and screen assembly, with the plug assembly of the present invention being run in for insertion into a landing receptacle connected to the production packer.

In the description which follows, like parts are indicated throughout the specification and drawings with the same reference numerals, respectively. The drawings are not necessarily to scale and the proportions of certain parts have been exaggerated to better illustrate details of the invention.

Referring now to FIG. 1, the packer plug assembly 10 is shown as it is being lowered within a well casing 12 which has been installed within a well bore 14 which intersects multiple earth formations 16, 18 and 20. The annulus between the tubular well casing 12 and the well bore 14 is sealed by an annular cement deposit 22 to prevent flow communication between the various formations intersected by the well bore 14. The lowermost formation 20 is a hydrocarbon formation, and the well casing 12 has been perforated by a perforating gun to produce openings 24 through the well casing for admitting formation fluid into the well.

The well is completed with a flow conductor 26, which may be retrievable or permanent production packer, which seals off the high pressures of the producing formation 20 to prevent those high fluid pressures from acting against the casing connections at the well head, and to prevent the application of the high fluid pressures to the tubular well casing 12, thus constraining the flow of formation fluid through the production bore 28 of the packer. For this purpose, a sand screen assembly 30 is coupled to the packer mandrel 32 by a length of production tubing 34. The packer 26 is a retrievable or permanent production packer which is set against the well casing by anchor slips 36. The annulus between the packer mandrel 32 and the well casing 12 is sealed by expandable seal elements 38A, 38B, 38C.

The flow of formation fluid through the packer mandrel bore 28 is produced to the surface through an upper tubing string (not illustrated). The upper production tubing string is coupled in flow communication with the production bore of the packer mandrel 32 by a landing receptacle 40, also sometimes referred to as a top sub or receiving head. The landing receptacle 40 is tubular flow conductor which is coupled to the packer mandrel 32 by a threaded union T. In this embodiment, the landing receptacle 40 includes a latch retainer lug 42. Typically, the landing receptacle 40 will include three retainer lugs 42 which project radially inwardly into the bore of the landing receptacle at symmetrically spaced locations. The latch retainer lugs 42 are adapted for releasable, interlocking engagement with a seal sub carried on the lower end of the upper production tubing string.

The packer plug 10 is suspended from the lower end of a tubular work string 44 by a running tool 46. The packer plug 10 is shown as it is being lowered into the landing receptacle 40 for insertion into the mandrel bore 28 of the production packer 26, to temporarily suspend production for example to permit a service operation to be carried out in an upper formation interval, or to shut in the lower formation interval because of depletion or inadequate production. The packer plug 10, when fully inserted, seals the packer mandrel bore 28, thus isolating the lower formation interval below the packer. That is, the packer plug prevents pressure fluctuations from the lower formation interval from interfering with completion operations being carried on in an upper formation interval. Likewise, the packer plug 10 shields the lower formation interval with respect to high pressure fluctuations and debris which might be produced during perforation of the well casing or stimulation in an upper formation interval. By isolating the lower formation interval, the well casing may be perforated in an under balanced pressure condition, without being affected by pressure fluctuations from the lower formation interval 20.

Figure 2:
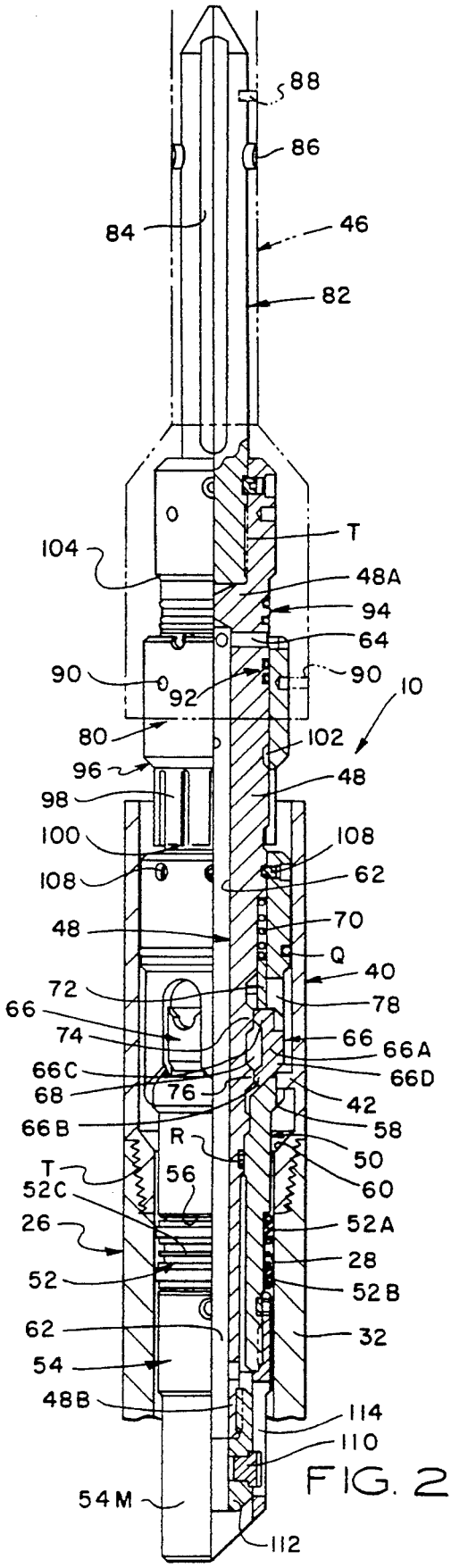
FIG. 2 is a simplified, sectional view which illustrates preliminary insertion of the plug assembly into the bore of the landing receptacle and production packer.

Because of the limitations on torque transmission, it is desirable to provide a retrievable packer plug which can be set and released by straight set-down and straight pull, respectively, without requiring rotation of the plug, so that the retrievable packer plug can be used reliably in highly deviated and horizontal well completions, as well as in vertical well completions as illustrated in FIG. 1. In keeping with that general object, the packer plug 10 of the present invention is adapted for installation by a one trip straight insertion operation, and is released by a one trip straight pull operation. This is achieved by the plug assembly 10 which includes as its principal components a tubular core mandrel 48, which is concentrically received within a tubular latch mandrel 50, having an upper mandrel section 50A and a lower mandrel section 50B, and an annular seal assembly 52, consisting of a stack of annular seal elements 52A, 52B which are separated by a spiral retainer ring 52C mounted about the lower mandrel section 50B of the latch mandrel 50. The retainer ring 52C separates the seals 52A, 52B so that they will not load each other. As shown in FIG. 2, the seal elements 52A, 52B are disposed in sealing engagement against the production bore 28 of the packer mandrel 32.

The seal assembly 52 is retained on the lower latch mandrel section 50B between a guide sub 54 and an annular shoulder 56. The guide sub 54 has a tubular sidewall 54M which provides a conventional mule shoe guide with a truncated entry face 54T. The slip annulus between the latch mandrel 50 and the bore sidewall of the landing receptacle 40 is closed by a debris barrier wiper ring Q. The purpose of the debris barrier wiper ring Q is to block sediments such as sand from entering into the annular latch pocket where it might interfere with movement of the latch components. The wiper ring Q thus increases the reliability of the plug 10. The slip annulus between the core mandrel 48 and the latch mandrel 50 is sealed by an O-ring seal R.

The plug 10 is inserted through the landing receptacle 40 and into the packer mandrel bore 28 until the seal bore 28 of the packer mandrel is encountered. Additional force may be required to drive the plug into the packer mandrel bore, especially since the seal rings 52A, 52B fit tightly therein. If necessary, this may be carried out by downward jarring impacts generated by operation of weighted tubing jars and reciprocation of the tool string. Insertion travel of the plug 10 within the packer bore 28 is limited by engagement of a downwardly facing no-go shoulder 58 formed on the lower end of the latch mandrel 50, and by an upwardly facing no-go shoulder 60 formed on the lower end of the landing receptacle 40.

During insertion of the plug assembly 10, it is desirable to equalize the pressure across the plug. For this purpose, the core mandrel 48 is partially intersected by a longitudinal bore 62. The core mandrel 48 has a head portion 48A and a body portion 48B, with the body portion 48B being adapted for supporting the latch mandrel 50 and the head portion 48A being adapted for attachment to the fishing neck 82. The plug body is intersected by the longitudinal bore 62 which extends the length of the body portion 48B, and terminates at the head portion 48A. The body portion 48B is also intersected by a radial equalizing port 64 which opens into communication with the longitudinal bore 62. Together, the longitudinal bore 62 and radial equalizing port 64 define a vent passage through the plug body for equalizing pressure across the plug. During insertion, the radial equalizing port 64 is open, and is closed only upon withdrawal of the running tool 46 and is subsequently re-opened upon retrieval, as discussed below.

The plug assembly 10 is adapted for releasable, interlocking engagement with the landing receptacle 40 by a moveable latch key 66 which is received within a annular latch pocket 68 formed between the core mandrel 48 and the latch mandrel 50. Referring to FIG. 2, the latch key 66 is shown in the run-in position, engaged against the latch retainer lug 42 as the plug 10 is inserted into the packer mandrel bore 28. In this position, the latch key 66 is blocked against axial displacement relative to the landing receptacle 40 as the core mandrel 48 is inserted into the packer mandrel bore 28. The latch key 66 is biased into engagement with the latch retainer lug 42 by a coil spring 70 and a tubular sleeve 72, both of which are mounted for slideable movement along the core mandrel body 48.

As shown in FIG. 2, the latch key 66 is blocked by engagement with the retainer lug 42, and it is supported in radially offset relation with respect to the core mandrel 48 by first and second raised shoulder portions 74, 76. The latch key 66 has a body portion 66A, first and second inner-boss members 66B, 66C and an outer-boss member 66D. The first and second inner-boss members are disposed in surface engagement with the raised shoulder portions 74, 76, respectively. The outer-boss member 66D is received within a longitudinal slot 78 formed in the latch mandrel 50. According to this arrangement, the latch key 66 is urged against the retainer lug 42 by the coil spring 70 as the core mandrel 48 is extended into the packer bore.

Figure 3:
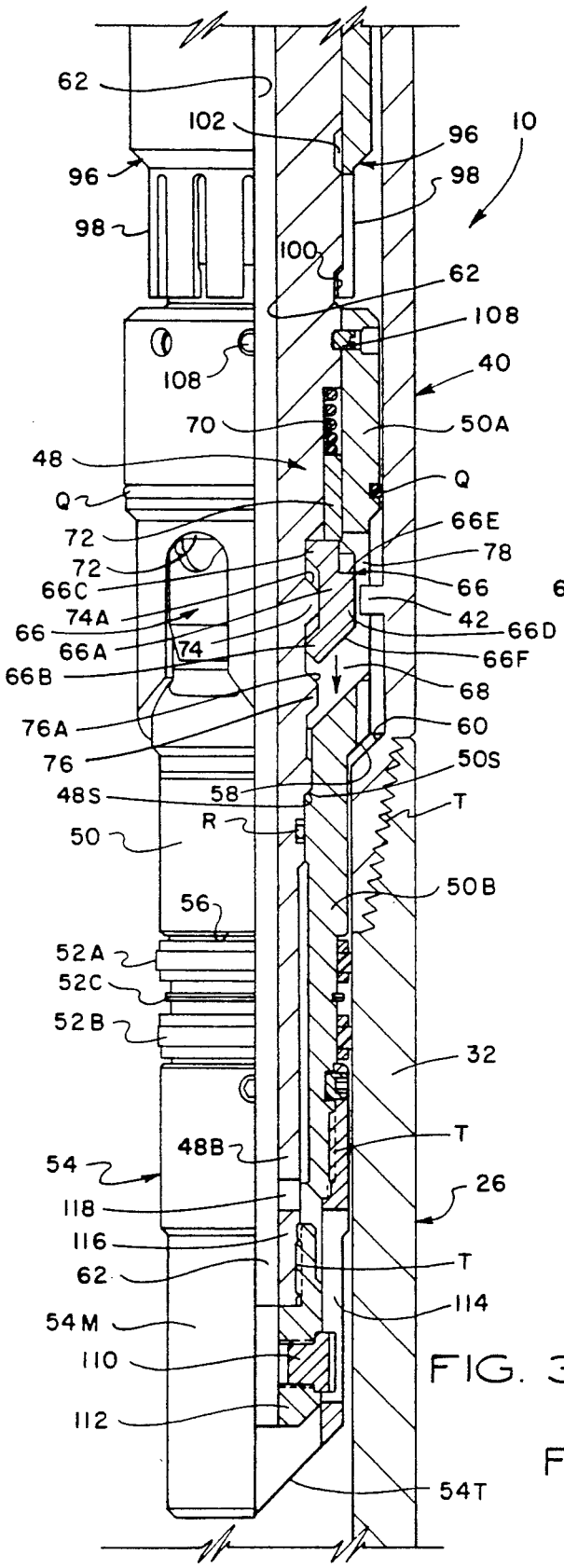
FIG. 3 is a view similar to FIG. 2 which illustrates radial retraction of the latch key to permit full insertion and latching engagement.

Referring now to FIG. 3, as the core mandrel 48 continues downward movement relative to the retainer lug 42, the latch key 66 is driven into a straddling position in which its body portion 66A rides on top of the raised shoulder portion 74, with its inner-boss members 68B, 68C being engaged against the external surface of the core mandrel 48, and with the outer-boss member 66D clearing the retainer lug 42. As indicated by the arrow, the latch key 66 is being driven longitudinally downwardly by the coil spring 70 through the latch pocket 68, with its movement being guided by engagement against the latch mandrel sidewalls on opposite sides of the latch mandrel slot 78. The movement of the latch key 66 is also guided by ramp surfaces 74A, 76A formed on the raised shoulders 74, 76 respectively.

Figure 4:
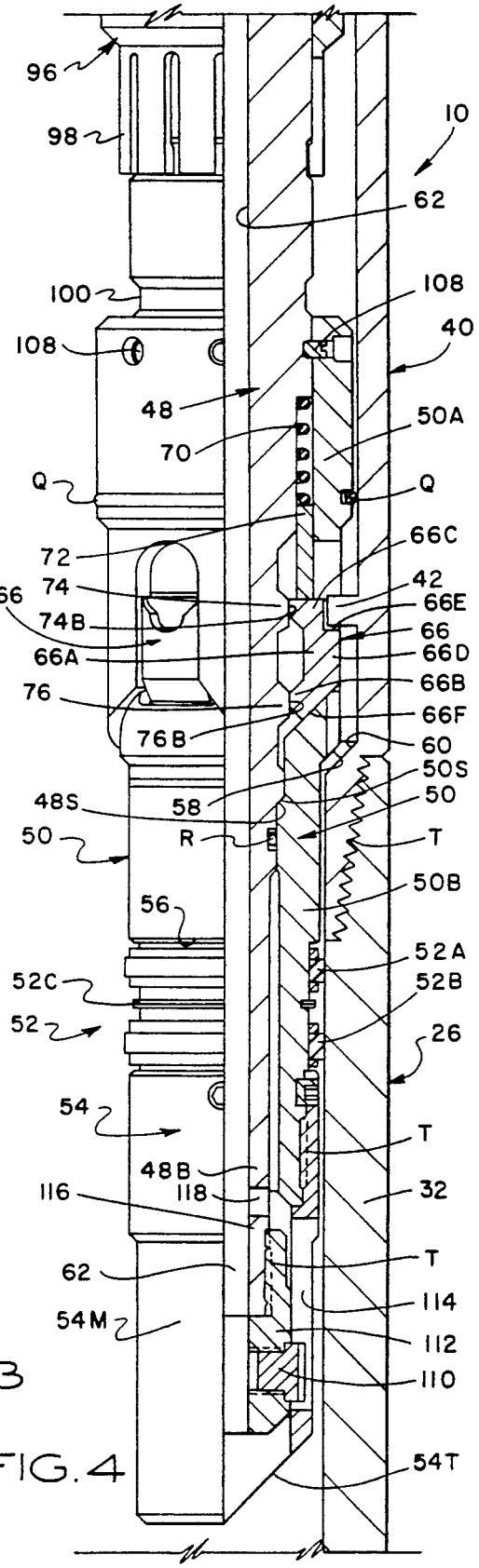
FIG. 4 is a view similar to FIG. 3 which shows interlocking engagement of the latch key with a retainer lug of the landing receptacle.

Referring now to FIG. 4, at the limit of insertion of the core mandrel 48 into the packer mandrel bore, the no-go surfaces 58, 60 engage and the latch key 66 is driven up to ride on the support surfaces 74B, 76B of the raised shoulder portions, respectively. As this occurs, the outer boss portion 66D is extended radially through the latch pocket 68 into engagement with the lower face of the retainer lug 42. The outer boss portion 66D of the latch key has a radially inset shoulder 66E for engaging the underside of the retainer lug 42. The latch key 66 is thus captured between the core mandrel 48 and the retainer lug 42, and by the raised shoulder portions 74, 76.

The latch mandrel 50 is secured to the lower end of the core mandrel 48 by the mule shoe sub 54. Consequently, upper retraction movement of the plug relative to the landing receptacle is blocked by the retainer lug 42, and the plug 10 is secured in sealing engagement within the packer mandrel bore. The latch key 66 has first and second axially spaced surfaces 66E, 66F, with the forward sloping face 66F sliding against the retainer lug 42 to cause the latch key to be retracted radially inwardly, and thereafter, the radially inset face 66E engages the underside the retainer lug to provide interlocking engagement of the plug assembly and landing receptacle. The sloping face 66F is complementary with the sloping face 60 of the landing receptacle no-go shoulder. This provides a more reliable release from the receptacle retainer member (lugs 42 or threads 126).

Referring to FIG. 2, after the plug has been set within the mandrel bore of the packer, the running tool 46 is retrieved to the surface. For the reasons previously stated, it is desirable to close the equalization port 64 to provide isolation of the lower production interval. According to one aspect of the present invention, the equalization port 64 is closed automatically by an isolation sleeve 80 which is mounted in slideable, sealing engagement against the core mandrel 48. The isolation sleeve 80 is shiftable along the longitudinal axis of the core mandrel 48 from a first position, as shown in FIG. 2, in which the equalizing port 64 is uncovered and the vent passage 62 is open, to a second position, as shown in FIG. 4 and FIG. 5, in which the equalizing port 64 is covered and sealed. Preferably, closure of the equalization port 64 is brought about automatically upon separation of the running tool from the plug assembly.

Referring again to FIG. 2, an elongated fishing neck 82 is attached to the core mandrel head 48B by a threaded union T. The fishing neck 82 has radially projecting lugs 86 for coupling engagement with the J slot coupling member of a retrieving tool 106 (See FIG. 5 and FIG. 6). The running tool 46 is assembled and secured by shear pins 88, 90 to the fishing neck 82 and to the isolation sleeve 80, respectively, prior to insertion into the well bore.

After locking engagement has been achieved as shown in FIG. 4, a straight upward pull is exerted on the work string 44, producing separation of the first set of shear pins 88. As this occurs, the isolation sleeve 80 is shifted upwardly to the covering position, as shown in FIG. 4 and FIG. 5, in which the equalization port 64 is blocked. Preferably, the sealing engagement between the isolation sleeve 80 and the core mandrel 48 is enhanced by annular O-ring seals 92, 94 which are received in annular grooves formed on the core mandrel 48A at longitudinally spaced locations on opposite sides of the equalizing port 64. When the isolation sleeve 80 is shifted to the covered position, as shown in FIG. 5, the equalization port 64 is sealed, and the vent passage 62 is closed.

Preferably, the position of the isolation sleeve 80 is stabilized by a collet 96 which is attached to the lower end of the isolation sleeve 80. The collet 96 has multiple resilient latching fingers 98 which are adapted for detented engagement within longitudinally spaced annular locator slots 100, 102, which are formed around the core mandrel body portion 48A.

The combined separation strength of the second set of shear pins 90 is greater than the detent strength of the collet 96, so that after the first set of shear pins 88 shear, the running tool 46 will separate from the fishing neck 84 and shift the isolation sleeve 80 to the covered, closed port position as shown in FIG. 5. Further shifting movement of the isolation sleeve 80 is blocked by an annular shoulder 104 which is formed on the core mandrel body portion 48. When the isolation sleeve 80 is driven to the covered position, the collet fingers 98 are received in detented engagement in the upper annular slot 102, thus stabilizing the isolation sleeve in the covered position while the plug 10 is secured within the packer 26.

As the pulling force continues, the shear pins 90 separate, thus releasing the running tool 46 for retrieval to the surface.

Referring now to FIG. 5 and FIG. 6, the retrieving tool 106 is applied against the isolation sleeve 80 to shift it from the covered position (FIG. 5) to the uncovered (equalize) position (FIG. 6), thus permitting equalization of pressure across the packer 26. The retrieving tool 106 has a head 106H which applies a set down force against the isolation sleeve 80. As the work string is lowered, the retrieving tool 106 pushes against the isolation sleeve downwardly, thus overcoming the detent engagement of the resilient fingers 98 within the upper groove 102. As detent engagement is released, the isolation sleeve 80 shifts downwardly to the uncovered position shown in FIG. 6. This opens the core mandrel vent passage 62 and the equalizing port 64, thus permitting the pressure in the wellbore below the packer to equalize with the pressure in the wellbore above the packer.

The plug 10 is released and retrieved to the surface by a straight upward pull on the retrieving tool 106. After pressure equalization has been obtained, the work string 44 is pulled straight upwardly, with the blocking shoulder 66E of the latch key 66 being forced against the retainer lug 42, as shown in FIG. 5. The pulling force is increased until separation of the shear pins 108 is obtained. When the shear strength of the separation pins 108 is exceeded, the pins separate into two portions, 108A, 108B as shown in FIG. 7. This releases the core mandrel 48 so that it can be retracted relative to the latch mandrel 50. The core mandrel 48 is slidably secured to the latch mandrel 50 by a guide pin 110 which is threaded onto a tubular mandrel cap 112. The guide projects into a longitudinal slot 114 which is formed in the tubular mule shoe side wall 54M of the guide sub 54.

The primary purpose of the guide pin 110 and longitudinal slot 114 is to permit torque to be transmitted by the work string directly to the keys 66. The running tool 106 engages the lugs on the fishing neck 82 for torque transmission. The threaded connection T between the tubular latch mandrel 50 and the guide sub 54 is left-hand so that a right hand work string torque will not unscrew the connection. Because of this arrangement, the shear screws are decoupled with respect to rotational torque forces and downward jarring forces during run-in. Referring to FIG. 4, the housing 50 cannot move upwards with respect to the core mandrel 48 due to engagement of the no-go stop shoulders 48S, 50S. Consequently, the plug 10 can be rotated and jarred down through tight bore sections and debris while running in, without damaging the shear screws.

If the plug 10 cannot release from the receptacle 40, then the retrieving tool 106 can be released from the fishing neck 82 by rotating the retrieving tool with respect to the fishing neck, while the plug remains stationary. The release shear pins 108 are protected from forces which would shear them except when the plug is installed and tension is applied from the work string. That is, while running the plug 10 in the well, a downward jar or rotation will not load the shear pins 108. Also, in the event the plug 10 needs to be milled, the plug will not rotate and the keys will be maintained locked in the top sub receptacle 40.

Upon separation of the shear pins 108, the core mandrel 48 is permitted to retract upwardly relative to the latch mandrel 50 as the guide pin 110 travels through the slot 114. As this occurs, the latch key 66 is pushed radially inwardly to straddle the lower raised shoulder portion 76, thus providing radial clearance between the latch key and the retainer lug 42. As the work string 44 continues to be retrieved, the core mandrel 48 is retracted longitudinally within the latch mandrel 50 until the cap 112 engages the lower end of the latch mandrel (FIG. 7). The entire plug assembly 10 may then be retracted out of the packer mandrel bore and out of the landing receptacle 40 for retrieval to the surface. Thereafter, a production string may be inserted into the landing receptacle 40 for resumption of production from the lower formation interval 20.

According to another aspect of the present invention, the plug 10 is designed with a member 116 which is threaded into engagement with the tubular mandrel cap 112. Referring to FIG. 4, the sidewall thickness of the tubular linking member 116 is reduced by the undercut of the threads T. This undercut reduces the tensile strength of the linking member relative to the core mandrel sidewall 48B. By this arrangement, the plug 10 is designed so that it can be forcibly separated from the latch mandrel 50 and the landing receptacle 40 during an emergency separation. Emergency separation is obtained by a strong upwardly pull on the work string, with the movement of the latch mandrel being blocked by the key by engagement of the key 66 against the lug 42. When the separation strength of the sacrificial linking member 116 is exceeded, it will part at the lower end of the core mandrel 48B and allow the work string to be retrieved. The fishing neck 82, isolation sleeve 80 and core mandrel 48 will be retrieved along with the work string. A second run can then be made with a milling tool or with a fishing tool to retrieve the latch mandrel 50 and associated components.

Figure 8:
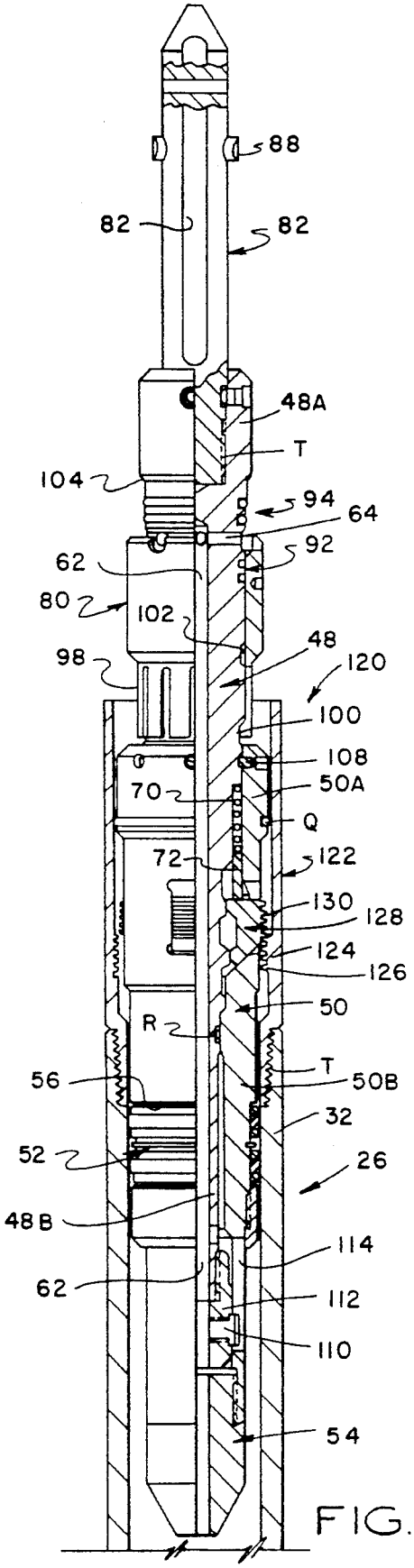
FIG. 8 is a view similar to FIG. 2 which illustrates an alternative embodiment in which latching engagement is provided by a threaded latch key and a threaded retainer.
Figure 9:
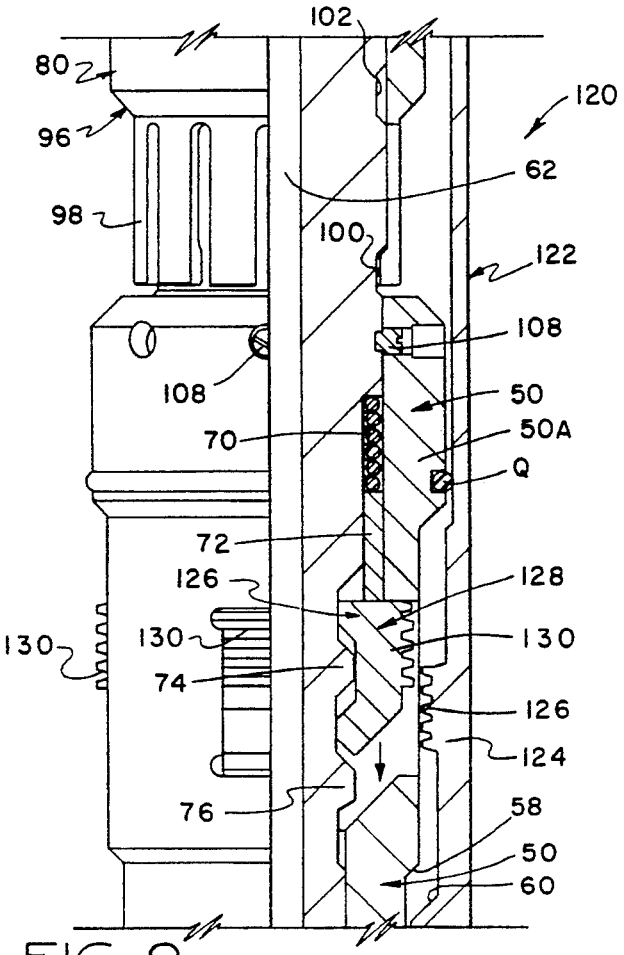
FIG. 9 is a simplified, sectional view similar to FIG. 8 which illustrates retraction of the threaded key out of engagement with the threaded retainer to permit full insertion of the plug assembly into the bore of the production packer; and, FIG. 10 is a view similar to FIG. 9 which shows interlocking engagement of the threaded latch key with the threaded retainer of the landing receptacle.
Figure 10:
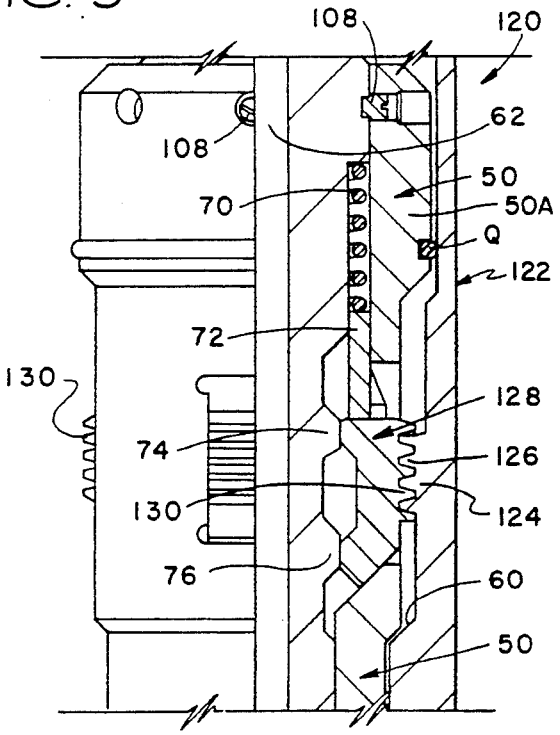

The lower end 48B of the core mandrel 48 is intersected by a radial bypass port 118. The bypass port 118 is in flow communication with the slot 114 to provide emergency relief should the main bore passage 62 become blocked. Referring now to FIG. 8, FIG. 9, and FIG. 10, an alternative plug assembly 120 is illustrated. In this installation, a landing receptacle 122 is secured to the packer mandrel 32. The landing receptacle 122 is provided with a latch retainer 124 having rachet threads 126. Preferably, the threads 126 have a helical pitch and a standard ACME profile. The latch assembly 120 carries a latch key 128 which includes complementary ACME threads 130. Insertion, locking engagement equalization and release are carried out exactly in the same manner as described above.

When the alternative embodiment shown in FIGS. 8, 9 and 10 is installed, the operator has the option of releasing the plug 120 from the landing receptacle 122 by rotation instead of by straight shear release. The plug 120 may then retrieved from the well or reinstalled, as desired. Reinstallation may be desirable for opening the flow conductor (packer) so that the upper well bore may communicate with the lower well bore, for example during short term production tests, or when it is desired to kill the well and thereafter reinstall the plug.

Although the invention has been described with reference to a vertical well completion and with reference to particular preferred embodiments, the foregoing description is not intended to be construed in a limiting sense. The packer plug of the present invention may be used to good advantage in alternative applications in which a well is completed with a packer, for example in gas wells, environmental wells, including monitoring wells, recovery wells and disposal wells, including deviated and horizontal well completions. It is therefore contemplated that the appended claims will cover any such applications which incorporate the plug assembly of the present invention.

What is claimed is:

1. A plug assembly for sealing the production bore of a flow conductor of the type having a landing receptacle and a latch retainer member for coupling engagement with a tubing member, said plug assembly comprising, in combination;

an elongated core mandrel;

a latch mandrel coupled to said core mandrel, said latch mandrel having a tubular sidewall radially spaced from said core mandrel thereby defining an annular latch pocket;

an annular seal assembly disposed about said latch mandrel for sealing engagement against the production bore of a flow conductor;

a latch key disposed in said latch pocket for longitudinal travel and radial movement relative to said core mandrel from a first position in which said key is radially extended relative to said core mandrel for engagement against the latch retainer member of a landing receptacle and is blocked by said latch retainer member against axial displacement relative to said landing receptacle as said core mandrel is pulled away from the landing receptacle, to a second position in which said latch key is longitudinally shifted and radially retracted with respect to the first position, whereby said latch key is released from blocking engagement to permit axial movement of said latch key relative to said landing receptacle; and, bias apparatus coupled to said latch key for yieldably opposing longitudinal travel of said key from the radially extended first position to the radially retracted second position, and for urging said key for longitudinal travel from the radially retracted second position to the radially extended first position.

2. A plug assembly as defined in claim 1, said bias apparatus comprising:

a coil spring disposed about said core mandrel; and, a tubular sleeve mounted on said core mandrel for longitudinal movement, said tubular sleeve having a first end portion engaging said latch key and a second end portion engaging said spring.

3. A plug assembly as defined in claim 1, wherein the tubular sidewall of said latch mandrel is intersected by a longitudinal slot, said latch key having an outside boss portion received within said slot, and the landing receptacle latch retainer having a boss portion disposed for insertion into said slot when said plug is inserted into the flow conductor.

4. A plug assembly as defined in claim 1, wherein said latch mandrel has a no-go shoulder and said landing receptacle has an annular no-go shoulder which are engageable with each other upon full insertion of said plug into the flow conductor.

5. A plug assembly as defined in claim 1, wherein said core mandrel is concentrically disposed within said latch mandrel and is releasably secured thereto by shear pins, said annular seal assembly being mounted on the external surface of said latch mandrel.

6. A plug assembly as defined in claim 1, including a guide sub coupled to said latch mandrel and disposed about said core mandrel, said guide sub having a tubular sidewall which is intersected by a longitudinal slot, and including a guide pin coupled to said core mandrel and projecting radially into said slot.

7. A plug assembly as defined in claim 1, including an annular debris barrier wiper ring mounted on said latch mandrel and engaging the interval bore sidewall of said landing receptacle when said plug is inserted into the flow conductor.

8. A plug assembly as defined in claim 1, including an annular seal member mounted on said core mandrel and disposed in sealing engagement with the bore of said latch mandrel.

9. A plug assembly as defined in claim 1, said core mandrel including a raised shoulder portion having a surface for supporting said latch key in the radially extended position, and having first and second ramp surfaces for guiding said latch key as it is moved from the retracted position on the core mandrel to the extended position on said shoulder support surface.

10. A plug assembly as defined in claim 1, said latch key including a body portion having first and second inner boss members and an outer boss member, said first and second inner boss members being axially spaced with respect to each other, and said core mandrel having first and second raised shoulder portions which are axially spaced with respect to each other, each shoulder portion having a surface for engaging the first and second inner boss members when said latch key is in the radially extended position, and said inner boss members straddling one of said raised shoulder portions when said latch key is in the radially retracted, non-blocking position.

11. A plug assembly as defined in claim 10, each raised shoulder portion having first and second ramp surfaces transitioning traversely from said core mandrel to said shoulder support surface for guiding the inner boss member as said latch key is moved to the radially retracted position on the core mandrel to the radially extended position or the shoulder support surfaces.

12. A plug assembly as defined in claim 1, including an elongated fishing neck attached to said core mandrel and adapted for releasable coupling engagement with a running tool for plug insertion, and with a retrieving tool for plug removal.

13. A plug assembly as defined in claim 1, wherein said landing receptacle latch retainer member is a lug which projects radially into the bore of said landing receptacle, and said latch key including a body portion having an outer boss member, said outer boss member having first and second axially spaced surfaces for engaging opposite sides of said lug during insertion and withdrawal of said plug into and out of the flow conductor, respectively, said first boss surface sloping transversely with respect to the longitudinal axis of said latch key

14. A plug assembly as defined in claim 1, said core mandrel having an elongated body portion disposed within said latch mandrel and having a head portion projecting out of said latch mandrel, said core mandrel body portion being intersected by a longitudinal bore and by a radial equalizing port in communication with the longitudinal bore, thereby defining a vent passage through said plug body portion for equalizing pressure across said plug; and, a valve closure member coupled to said core mandrel for opening and closing said equalizing port.

15. A plug assembly as defined in claim 14, said valve closure member comprising an isolation sleeve disposed in slideable, sealing engagement against said core mandrel, said isolation sleeve being shiftable along the longitudinal axis of said core mandrel from a first portion in which said equalizing port is uncovered and the vent passage is open, to a second portion in which said equalizing port is covered and sealed by said isolation sleeve.

16. A plug assembly as defined in claim 15, including:

first and second annular seal members mounted on said core mandrel at longitudinally spaced locations on opposite sides of said equalizing port; and, said isolation sleeve being disposed in sealing engagement with said annular seal members when shifted to said covered position.

17. A plug assembly as defined in claim 15, said core mandrel body being intersected by first and second longitudinally spaced annular locator slots, and including a collet attached to said isolation sleeve, said collet having multiple resilient latching fingers adapted for detented engagement in said first and second annular locator slots, respectively, when said isolation sleeve is shifted to said covered and uncovered positions, respectively.

18. A plug assembly as defined in claim 14, including:

a running tool shearably coupled to said valve closure member and to said core mandrel, said running tool maintaining said valve closure member in the uncovered, open port position during run-in, and said running tool shifting said valve closure member to the covered, closed port position in response to shear release and upward movement of said running tool from said core mandrel.

19. A plug assembly as defined in claim 18, including:
a set of shear pins releaseably coupling said running tool to said valve closure member;
a collet mounted on said core mandrel and attached to said isolation sleeve, said collet having multiple resilient latching fingers disposed in detented engagement with said core mandrel; and,
wherein the combined separation strength of the second set of shear pins is greater than the detent strength of said collet, so that the running tool will release said collet and shift said valve closure member to the covered, closed port position before separation of said shear pins occurs.

20. A plug assembly as defined in claim 1, wherein the tubular sidewall of said latch mandrel is intersected by a longitudinal slot, said latch key having an outside boss portion received within said slot, said outside boss portion being intersected by multiple grooves thereby defining radially projecting latch key threads, and the landing receptacle latch retainer having a boss portion disposed for insertion into said slot when said plug is inserted into said flow conductor, said latch retainer boss portion being intersected by multiple grooves, thereby defining radially projecting latch retainer threads, the latch key threads being adapted for threaded engagement with the latch retainer threads when said latch key is in the radially extended position.

21. A plug assembly as defined in claim 1, said elongated core mandrel having a head portion and a body portion, including shear screws securing said body portion to said latch mandrel, and said latch mandrel having a tubular guide member intersected by a longitudinal slot, and including a guide pin coupled to said core mandrel body portion and projecting radially into said slot.

22. A plug assembly as defined in claim 1, said elongated core mandrel having a head portion and a body portion, including a fishing neck attached to said core mandrel head portion, and a linking member interconnecting said core body portion to said latch mandrel, said linking member being characterized by a tensile strength which is substantially less than the tensile strength of said core mandrel body portion.

23. A plug assembly as defined in claim 22, wherein said core mandrel body portion is intersected by a longitudinal bore, including a tubular guide member secured by threaded engagement to said core mandrel body portion, said tubular guide member being intersected by a longitudinal slot, and a guide pin coupled to said core mandrel body portion and projecting radially into said slot, said linking member comprising the threaded portion of said core mandrel body portion.

24. A plug assembly for sealing the production bore of a flow conductor of the type having a landing receptacle and a latch retainer member adapted for coupling engagement with a tubing member, said plug assembly comprising, in combination:
a latch mandrel having a longitudinal bore;
an annular seal assembly coupled to said latch mandrel for sealing engagement against the production bore of a flow conductor;
an elongated core mandrel disposed for longitudinal displacement within said latch mandrel bore, said core mandrel being coupled in slidable, sealing engagement with said latch mandrel bore;
latch apparatus coupled to said core mandrel for releasably locking said core mandrel to said latch retainer member on said landing receptacle;
a set of shear pins shearably connecting said latch mandrel to said core mandrel; and
a guide assembly coupled to said core mandrel for limiting longitudinal displacement and for blocking rotational movement of said core mandrel relative to said latch mandrel.

25. A plug assembly as defined in claim 24, said guide assembly including a tubular guide member attached to said latch mandrel, said tubular guide member being intersected by a longitudinal slot, and including a guide pin attached to said core mandrel and projecting radially into said slot.

26. A plug assembly as defined in claim 24, including:
a sacrificial linking member interconnecting said core mandrel to said latch mandrel, said linking member being characterized by a tensile strength which is substantially less than the tensile strength of said core mandrel.

27. A plug assembly for sealing the production bore of a flow conductor of the type having a landing receptacle and a latch retainer member for coupling engagement with a tubing member, said plug assembly comprising, in combination:
an elongated core mandrel;
latch apparatus mounted on said core mandrel for releasably locking said core mandrel to said latch retainer member on said landing receptacle;
an annular seal assembly coupled to said core mandrel for sealing engagement against the production bore of a flow conductor;
said core mandrel having an elongated body portion which is intersected by a longitudinal bore and by a radial equalizing port in communication with the longitudinal bore, thereby defining a vent passage through said plug body for equalizing pressure across said plug; and,
an isolation sleeve disposed in slideable, sealing engagement against said core mandrel, said isolation sleeve being shiftable along the longitudinal axis of said core mandrel from a first position in which said equalizing port is uncovered, to a second position in which said equalizing port is covered and sealed by said isolation sleeve.

28. A plug assembly as defined in claim 27, including:
first and second annular seal members mounted on said core mandrel on longitudinally opposite sides of said equalizing port; and,
said isolation sleeve being disposed in sealing engagement with said annular seal members when shifted to said covered position.

29. A plug assembly as defined in claim 27, said core mandrel body being intersected by first and second longitudinally spaced annular locator slots, and including a collet attached to said isolation sleeve, said collet having multiple resilient latching fingers adapted for detented engagement in said first and second annular locator slots, respectively, when said isolation sleeve is shifted to said covered and uncovered positions, respectively.

30. A plug assembly as defined in claim 27, including:
a running tool shearably coupled to said isolation sleeve and to said core mandrel, said running tool maintaining said isolation sleeve in the uncovered, open port position during run-in, and said running tool shifting said isolation sleeve to the covered, closed port position upon shearable release and upward movement of said running tool from said core mandrel.

31. A plug assembly as defined in claim 27, including:

a set of shear pins releaseably coupling said running tool to said isolation sleeve;

a collet mounted on said core mandrel and attached to said isolation sleeve, said collet having multiple resilient latching fingers disposed in detented engagement with said core mandrel; and, wherein the combined separation strength of said shear pins is greater than the detent strength of said collet, so that the running tool will release said collet and shift said isolation sleeve to the covered, closed port position before separation of said shear pins occurs.

32. A plug assembly as defined in claim 27, including:

a tubular latch mandrel disposed about said core mandrel, said latch mandrel having a tubular sidewall radially spaced from said core mandrel thereby defining an annular latch pocket;

said annular seal assembly being mounted on said latch mandrel;

a latch key disposed in said latch pocket for movement from a radially extended position in which said key is disposed for engagement against the latch retainer member of a landing receptacle and is blocked against axial displacement relative to said landing receptacle as said core mandrel is inserted into or withdrawn from the production bore of said flow conductor, to a radially retracted position in which said latch key is released from such blocking engagement to permit axial movement of said key relative to said landing receptacle; and, bias apparatus coupled to said latch key for yieldably opposing movement of said key from the radially extended position to the radially retracted position, and for urging said key from the radially retracted position to the radially extended position.

33. A plug assembly as defined in claim 32, said bias apparatus comprising:

a coil spring disposed about said core mandrel; and, a tubular sleeve mounted on said core mandrel for longitudinal movement, said tubular sleeve having a first end portion engaging said key and a second end portion engaging said spring.

34. A plug assembly as defined in claim 32, wherein the tubular sidewall of said latch mandrel is intersected by a longitudinal slot, said latch key having an outside boss portion received within said slot, and the landing receptacle latch retainer member having a boss portion disposed for insertion into said slot when said plug is inserted into the production bore of the packer.

35. A plug assembly as defined in claim 32, wherein said latch mandrel and said landing receptacle each have an annular no-go shoulder which are engageable with each other upon full insertion of said plug into the production bore of said packer.

36. A plug assembly as defined in claim 32, wherein said core mandrel is concentrically disposed within said latch mandrel and is releasably secured thereto by shear pins, said annular seal assembly being mounted on said latch mandrel.

37. A plug assembly as defined in claim 32, including a mule shoe sub attached to said latch mandrel, said mule shoe sub having a tubular sidewall which is intersected by a longitudinal slot, and including a guide pin coupled to said core mandrel and projecting into said slot.

38. A plug assembly as defined in claim 32, including an annular debris barrier seal mounted on said latch mandrel and disposed for sealing engagement against the bore of said landing receptacle when said plug is inserted into the production bore of said packer.

39. A plug assembly as defined in claim 32, including an annular seal member mounted on said core mandrel and disposed in sealing engagement with the bore of said latch mandrel.

40. A plug assembly as defined in claim 32, said core mandrel including a raised shoulder portion having a surface for supporting said latch key in the radially extended position, and having first and second ramp surfaces for guiding said latch key as it is moved from the retracted position on the core mandrel to the extended position on said shoulder support surface.

41. A plug assembly as defined in claim 32, said latch key including a body portion having first and second inner boss members and an outer boss member, said first and second inner boss member being axially spaced with respect to each other, and said core mandrel having first and second raised shoulder portion which are axially spaced with respect to each other, each shoulder portion having a surface for engaging first and second inner boss members when said latch key is in the radially extended position, and said inner boss members straddling one of said raised should portions when said latch key is in the radially retracted, non-blocking position.

42. A plug assembly as defined in claim 41, each raised shoulder portion having first and second ramp surfaces transitioning from said core mandrel to said shoulder support surface for guiding the inner boss member as said latch key is moved to the radially retracted position on the core mandrel to the radially extended position or the shoulder support surfaces.

43. A plug assembly as defined in claim 32, including an elongated fishing neck attached to said core mandrel and adapted for releasable coupling engagement with a running tool for plug insertion and with a retrieving tool for plug removal.

44. A plug assembly as defined in claim 32, wherein said landing receptacle latch retainer member is a lug which projects radially into the bore of said landing receptacle, and said latch key including a body portion having an outer boss member, said outer boss member having first and second axially spaced surfaces for engaging opposite sides of said lug during insertion and withdrawal of said plug into and out of the packer bore, respectively, said first boss surface sloping transversely with respect to the longitudinal axis of said latch key.

* * * * *